US008973588B2

(12) United States Patent
Sebastian et al.

(10) Patent No.: US 8,973,588 B2
(45) Date of Patent: Mar. 10, 2015

(54) PLASTICIZER COMPOSITION FOR DEGRADABLE POLYESTER FILTER TOW

(75) Inventors: Andries Don Sebastian, Clemmons, NC (US); Stephen Benson Sears, Siler City, NC (US); Thaddeus J. Jackson, High Point, NC (US); Grady Lance Dooly, Winston-Salem, NC (US)

(73) Assignee: R.J. Reynolds Tobacco Company, Winston-Salem, NC (US)

( * ) Notice: Subject to any disclaimer, the term of this patent is extended or adjusted under 35 U.S.C. 154(b) by 853 days.

(21) Appl. No.: 13/194,063

(22) Filed: Jul. 29, 2011

(65) Prior Publication Data

US 2013/0025610 A1 Jan. 31, 2013

(51) Int. Cl.

| | |
|---|---|
| ***A24D 3/08*** | (2006.01) |
| ***A24D 3/06*** | (2006.01) |
| ***A24D 3/14*** | (2006.01) |

(52) U.S. Cl.

CPC *A24D 3/08* (2013.01); *A24D 3/068* (2013.01); *A24D 3/14* (2013.01)

USPC ..... 131/332; 131/345

(58) Field of Classification Search

USPC ..... 131/345

See application file for complete search history.

(56) References Cited

U.S. PATENT DOCUMENTS

| | | | |
|---|---|---|---|
| 2,794,239 | A | 6/1957 | Crawford et al. |
| 2,953,838 | A | 9/1960 | Crawford et al. |
| 3,424,172 | A | 1/1969 | Neurath et al. |
| 3,890,983 | A | 6/1975 | Sawada et al. |
| 4,811,745 | A | 3/1989 | Cohen et al. |
| 5,012,829 | A | 5/1991 | Thesing et al. |
| 5,025,814 | A | 6/1991 | Raker |

(Continued)

FOREIGN PATENT DOCUMENTS

| | | |
|---|---|---|
| CN | 101 023 811 A | 8/2007 |
| CN | 101023811 | 8/2007 |

(Continued)

OTHER PUBLICATIONS

Agrawal et al., Constrained nonlinear optimization for solubility parameters of poly(lactic acid) and poly(glycolic acid)—validation and comparison, *Polymer*, 2004, pp. 8603-8612, vol. 45., No. 25.

(Continued)

*Primary Examiner* — Galen Hauth

(74) *Attorney, Agent, or Firm* — Womble Carlyle Sandridge & Rice, LLP

(57) ABSTRACT

A filter material adapted for use as a filter element of a smoking article is provided, the filter material being in the form of a fibrous tow that includes a plurality of filaments of a degradable polyester and a plasticizer composition applied thereto, the plasticizer composition and the degradable polyester having a Relative Energy Difference calculated using Hansen Solubility Parameters of less than about 1.3. Exemplary degradable polyesters include polyglycolic acid, polylactic acid, polyhydroxyalkanoates, polycaprolactone, polybutylene succinate adipate and copolymers or blends thereof. Exemplary plasticizer compositions include one or more of dimethylisosorbide, propylene carbonate, methylbenzyl alcohol, glycerol carbonate acetate, glycerol carbonate ethyl ether, and mixtures thereof, optionally in combination with triacetin. Filter elements and smoking articles, such as cigarettes, that contain the filter material are also provided.

20 Claims, 2 Drawing Sheets

(56) References Cited

U.S. PATENT DOCUMENTS

| | | | |
|---|---|---|---|
| 5,074,320 | A | 12/1991 | Jones, Jr. et al. |
| 5,225,277 | A | 7/1993 | Takegawa et al. |
| 5,396,909 | A | 3/1995 | Gentry et al. |
| 5,453,144 | A | 9/1995 | Kauffman et al. |
| 5,509,430 | A | 4/1996 | Berger |
| 5,709,227 | A | 1/1998 | Arzonico et al. |
| 5,718,250 | A | 2/1998 | Banerjee et al. |
| 5,817,159 | A | 10/1998 | Cahill et al. |
| 5,856,006 | A | 1/1999 | Asai et al. |
| 5,911,224 | A | 6/1999 | Berger |
| 5,913,311 | A | 6/1999 | Ito et al. |
| 5,947,126 | A | 9/1999 | Wilson et al. |
| 5,970,988 | A | 10/1999 | Buchanan et al. |
| 6,062,228 | A | 5/2000 | Loercks et al. |
| 6,087,465 | A | 7/2000 | Seppälä et al. |
| 6,344,349 | B1 | 2/2002 | Moldavsky et al. |
| 6,571,802 | B1 | 6/2003 | Yamashita |
| 6,595,217 | B1 | 7/2003 | Case et al. |
| 6,924,029 | B1 | 8/2005 | Caenen et al. |
| 6,984,631 | B2 | 1/2006 | Aranishi et al. |
| 7,435,208 | B2 | 10/2008 | Garthaffner |
| 7,896,011 | B2 | 3/2011 | Grubbs et al. |
| 2002/0166563 | A1 | 11/2002 | Jupe et al. |
| 2004/0261807 | A1 | 12/2004 | Dube et al. |
| 2005/0066981 | A1 | 3/2005 | Crooks et al. |
| 2007/0056600 | A1 | 3/2007 | Coleman, III et al. |
| 2008/0245376 | A1 | 10/2008 | Travers et al. |
| 2009/0032037 | A1 | 2/2009 | Xue et al. |
| 2009/0288669 | A1* | 11/2009 | Hutchens ..... 131/274 |
| 2011/0036366 | A1 | 2/2011 | Sebastian |
| 2012/0000477 | A1 | 1/2012 | Sebastian et al. |
| 2012/0000479 | A1 | 1/2012 | Sebastian et al. |
| 2012/0000480 | A1 | 1/2012 | Sebastian et al. |
| 2012/0000481 | A1 | 1/2012 | Potter et al. |
| 2012/0017925 | A1 | 1/2012 | Sebastian et al. |
| 2012/0024304 | A1 | 2/2012 | Sebastian |

FOREIGN PATENT DOCUMENTS

| | | |
|---|---|---|
| CN | 102 080 275 A | 6/2011 |
| CN | 102 080 278 A | 6/2011 |
| CN | 102080275 | 6/2011 |
| CN | 102080278 | 6/2011 |
| WO | WO 2012/175979 | 12/2012 |

OTHER PUBLICATIONS

Belmares et al., "Hildebrand and Hansen Solubility Parameters from Molecular Dynamics with Applications to Electronic Nose Polymer Sensors", *Journal of Computational Chemistry*, 2004, pp. 1815-1826, vol. 25, No. 15.

Hansen, Charles M., "What are HSP?" http://www.hansen-solubility.com/index.php?id=8, May 29, 2007.

Hansen, Charles M., "The Three Dimensional Solubility Parameter and Solvent Diffusion Coefficient" Copenhagen Danish Technical Press 1967.

* cited by examiner

PLASTICIZER COMPOSITION FOR DEGRADABLE POLYESTER FILTER TOW

FIELD OF THE INVENTION

The present invention relates to products made or derived from tobacco, or that otherwise incorporate tobacco, and are intended for human consumption. More particularly, the invention pertains to degradable filter compositions, including biodegradable compositions, for smoking articles such as cigarettes.

BACKGROUND OF THE INVENTION

Popular smoking articles, such as cigarettes, have a substantially cylindrical rod-shaped structure and include a charge, roll or column of smokable material, such as shredded tobacco (e.g., in cut filler form), surrounded by a paper wrapper, thereby forming a so-called "smokable rod" or "tobacco rod." Normally, a cigarette has a cylindrical filter element aligned in an end-to-end relationship with the tobacco rod. Typically, a filter element comprises plasticized cellulose acetate tow circumscribed by a paper material known as "plug wrap." Certain filter elements can incorporate polyhydric alcohols. Typically, the filter element is attached to one end of the tobacco rod using a circumscribing wrapping material known as "tipping paper." It also has become desirable to perforate the tipping material and plug wrap, in order to provide dilution of drawn mainstream smoke with ambient air. Descriptions of cigarettes and the various components thereof are set forth in Tobacco Production, Chemistry and Technology, Davis et al. (Eds.) (1999). A cigarette is employed by a smoker by lighting one end thereof and burning the tobacco rod. The smoker then receives mainstream smoke into his/her mouth by drawing on the opposite end (e.g., the filter end) of the cigarette.

The discarded portion of the cigarette rod is primarily composed of the filter element, which typically consists of tightly-compacted and highly crimped cellulose acetate fibers bonded at their contact points and wrapped by the plug wrap and tipping paper. The presence of the wrapping materials, the fiber-to-fiber bonding, and the compacted nature of conventional filter elements has a detrimental effect on the rate of degradation of cigarette filters in the environment. Unless the filter element is unwrapped and the fibers spread apart to increase exposure, biodegradation of the filter can take several years.

A number of approaches have been used in the art to promote an increased rate of degradation of filter elements. One approach involves incorporation of additives (e.g., water soluble cellulose materials, water soluble fiber bonding agents, photoactive pigments, degradable starch particles, or phosphoric acid) into the cellulose acetate material in order to accelerate polymer decomposition. See U.S. Pat. No. 5,913,311 to Ito et al.; U.S. Pat. No. 5,947,126 to Wilson et al.; U.S. Pat. No. 5,970,988 to Buchanan et al.; and U.S. Pat. No. 6,571,802 to Yamashita; and US Pat. Appl. Publication No. 2011/0036366 to Sebastian. Incorporation of slits into a filter element has been proposed for enhancing biodegradability, such as described in U.S. Pat. No. 5,947,126 to Wilson et al. and U.S. Pat. No. 7,435,208 to Garthaffner. U.S. Pat. No. 5,453,144 to Kauffman et al. describes use of a water sensitive hot melt adhesive to adhere the plug wrap in order to enhance biodegradability of the filter element upon exposure to water. U.S. Pat. No. 6,344,349 to Asai et al. proposes to replace conventional cellulose acetate filter elements with a filter element comprising a core of a fibrous or particulate cellulose material coated with a cellulose ester to enhance biodegradability.

In some cases, conventional cellulose acetate has been replaced with other materials, such as moisture disintegrative sheet materials, extruded starch materials, or polyvinyl alcohol. See U.S. Pat. No. 5,709,227 to Arzonico et al; U.S. Pat. No. 5,911,224 to Berger; U.S. Pat. No. 6,062,228 to Loercks et al.; and U.S. Pat. No. 6,595,217 to Case et al. U.S. application Ser. No. 12/827,618, filed Jun. 30, 2010, suggests the use of certain biodegradable polymers, such as polylactic acid, in a filter element for a cigarette. Formation of a cigarette filter using biodegradable polymers can be challenging because conventional plasticizers used in combination with cellulose acetate fibers are often poorly suited to plasticize other types of polymers.

Accordingly, there remains a need in the art for a smoking article filter exhibiting enhanced environmental degradation properties, particularly where the filter can be manufactured with only minor modification of conventional filter rod production equipment.

SUMMARY OF THE INVENTION

The present invention relates to a smoking article, and in particular, a rod-shaped smoking article (e.g., a cigarette). The smoking article includes a lighting end (i.e., an upstream end) and a mouth end (i.e., a downstream end). A mouth end piece is located at the extreme mouth end of the smoking article, and the mouth end piece allows the smoking article to be placed in the mouth of the smoker to be drawn upon. The mouth end piece has the form of a filter element comprising a fibrous tow filter material. The fibrous tow filter material incorporates filaments of a degradable polyester material and a plasticizer composition applied thereto. The plasticizer composition and the degradable polyester have a Relative Energy Difference calculated using Hansen Solubility Parameters of about 1.3 or less. Unlike conventional plasticizers used in the cigarette industry, certain embodiments of the plasticizer compositions of the invention are capable of providing the level of inter-fiber bonding necessary to achieve desirable cohesiveness and rigidity in a cigarette filter rod containing degradable polyester filaments such as polylactic acid.

In one aspect, the invention provides a fibrous tow adapted for use in a smoking article comprising a plurality of filaments of a degradable polyester (e.g., an aliphatic polyester) and a plasticizer composition applied thereto, the plasticizer composition and the degradable polyester having a Relative Energy Difference calculated using Hansen Solubility Parameters of less than about 1.3 (e.g., less than about 1.0 or less than about 0.8 or less than about 0.7). Exemplary degradable polyesters include polyglycolic acid (PGA), polylactic acid (PLA), polyhydroxyalkanoates (e.g., polyhydroxy butyrate (PHB) or polyhydroxy valerate (PHV)), polycaprolactone (PCL), polybutylene succinate adipate and copolymers or blends thereof. In one advantageous embodiment, the degradable polyester is polylactic acid or a blend or copolymer comprising polylactic acid. Blends of the degradable polyester with a second biodegradable polymer can also be used.

Exemplary solvents for use in the plasticizer composition include dimethylisosorbide, propylene carbonate, methylbenzyl alcohol, glycerol carbonate acetate, glycerol carbonate ethyl ether, and mixtures thereof. The plasticizer composition of the invention is often a mixture of triacetin with at least one additional solvent, such as those listed herein. For example, the plasticizer composition can include at least about 0.10 volume fraction of triacetin and at least one solvent selected from dimethylisosorbide, propylene carbonate, methylbenzyl alcohol, glycerol carbonate acetate, glycerol carbonate ethyl ether, and mixtures thereof. In another specific embodiment, the plasticizer composition includes at least about 0.5 volume fraction of dimethylisosorbide with the balance being triacetin (e.g., between about 0.5 and about 0.85 volume fraction of dimethylisosorbide and the balance being triacetin).

In addition to having an acceptable Relative Energy Difference with respect to the degradable polyester, the plasticizer composition will typically also meet the following criteria: a boiling point above about 200° C., a flash point above about 100° C., a National Fire Protection Agency health rating of 1 or less, and a National Fire Protection Agency fire rating of 1 or less.

In one particular embodiment of the invention, a fibrous tow adapted for use in a smoking article is provided, the tow including a plurality of polymeric filaments of polylactic acid, or a blend or copolymer comprising polylactic acid, and a plasticizer composition applied thereto, the plasticizer composition and the polymeric filaments having a Relative Energy Difference calculated using Hansen Solubility Parameters of less than about 1.3, and the plasticizer composition comprising triacetin in combination with one or more additional solvents, including any of the solvents or solvent combinations described herein.

In another aspect, the invention provides a smoking article such as a cigarette that includes a tobacco rod having a smokable filler material contained within a circumscribing wrapping material and a filter element connected to the tobacco rod at one end of the tobacco rod, the filter element comprising at least one segment of fibrous tow according to any of the embodiments set forth herein.

BRIEF DESCRIPTION OF THE DRAWINGS

In order to assist the understanding of embodiments of the invention, reference will now be made to the appended drawings, which is not necessarily drawn to scale. The drawings are exemplary only, and should not be construed as limiting the invention.

DETAILED DESCRIPTION OF THE PREFERRED EMBODIMENTS

The present inventions now will be described more fully hereinafter with reference to the accompanying drawings. The invention may be embodied in many different forms and should not be construed as limited to the embodiments set forth herein; rather, these embodiments are provided so that this disclosure will satisfy applicable legal requirements. Like numbers refer to like elements throughout. As used in this specification and the claims, the singular forms "a," "an," and "the" include plural referents unless the context clearly dictates otherwise.

Figure 1:
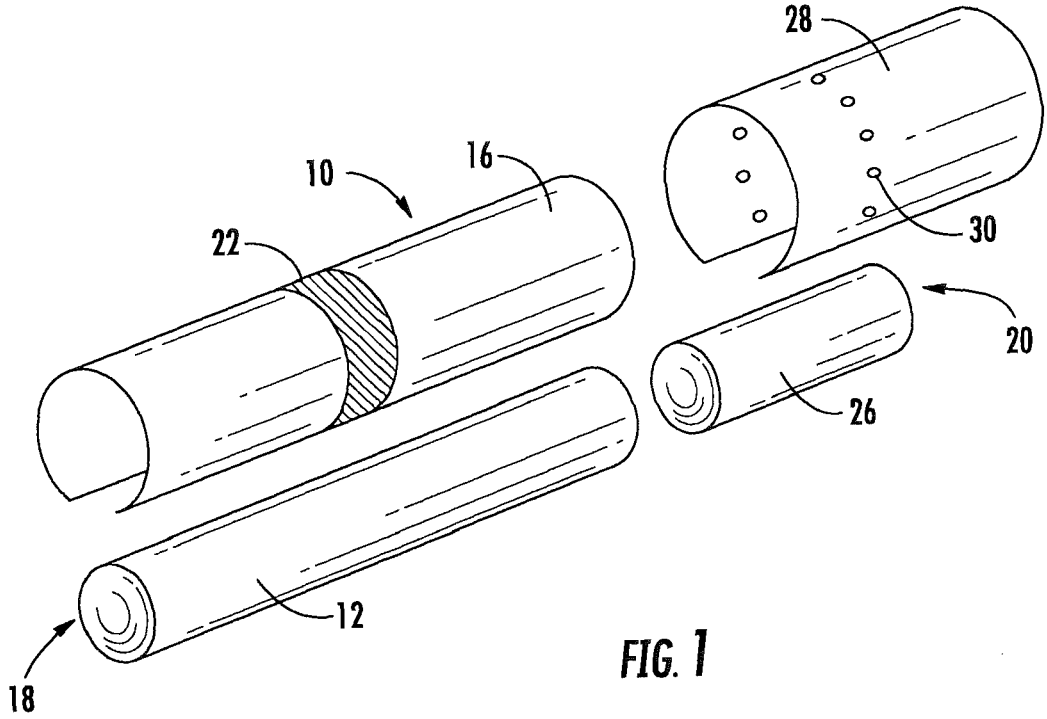
FIG. 1 is an exploded perspective view of a smoking article having the form of a cigarette, showing the smokable material, the wrapping material components, and the filter element of the cigarette.

Referring to FIG. 1, there is shown a smoking article 10 in the form of a cigarette and possessing certain representative components of a smoking article of the present invention. The cigarette 10 includes a generally cylindrical rod 12 of a charge or roll of smokable filler material contained in a circumscribing wrapping material 16. The rod 12 is conventionally referred to as a "tobacco rod." The ends of the tobacco rod 12 are open to expose the smokable filler material. The cigarette 10 is shown as having one optional band 22 (e.g., a printed coating including a film-forming agent, such as starch, ethylcellulose, or sodium alginate) applied to the wrapping material 16, and that band circumscribes the cigarette rod in a direction transverse to the longitudinal axis of the cigarette. That is, the band 22 provides a cross-directional region relative to the longitudinal axis of the cigarette. The band 22 can be printed on the inner surface of the wrapping material (i.e., facing the smokable filler material), or less preferably, on the outer surface of the wrapping material. Although the cigarette can possess a wrapping material having one optional band, the cigarette also can possess wrapping material having further optional spaced bands numbering two, three, or more.

At one end of the tobacco rod 12 is the lighting end 18, and at the mouth end 20 is positioned a filter element 26. The filter element 26 positioned adjacent one end of the tobacco rod 12 such that the filter element and tobacco rod are axially aligned in an end-to-end relationship, preferably abutting one another. Filter element 26 may have a generally cylindrical shape, and the diameter thereof may be essentially equal to the diameter of the tobacco rod. The ends of the filter element 26 permit the passage of air and smoke therethrough.

The filter element 26 is circumscribed along its outer circumference or longitudinal periphery by a layer of outer plug wrap 28. The outer plug wrap 28 overlies each of the first filter segment 32 and the second filter segment 36, so as to provide a combined, two-segment filter element.

The filter element 26 is attached to the tobacco rod 12 using tipping material (not shown), such as an essentially air impermeable tipping paper, that circumscribes both the entire length of the filter element 26 and an adjacent region of the tobacco rod 12. The inner surface of the tipping material is fixedly secured to the outer surface of the plug wrap 28 and the outer surface of the wrapping material 16 of the tobacco rod, using a suitable adhesive; and hence, the filter element and the tobacco rod are connected to one another.

A ventilated or air diluted smoking article can be provided with an optional air dilution means, such as a series of perforations 30, each of which extend through the tipping material and plug wrap 28. The optional perforations 30 can be made by various techniques known to those of ordinary skill in the art, such as laser perforation techniques. Alternatively, so-called off-line air dilution techniques can be used (e.g., through the use of porous paper plug wrap 28 and pre-perforated tipping paper).

The filter element 26 comprises one or more segments of fibrous tow comprising filaments constructed of a degradable polyester polymer. The degradable polyester polymer can be any polyester capable of undergoing significant degradation or decomposition through chemical reactions that break down the polymer into decomposition products under environmental conditions associated with disposal of the filter element. Exemplary degradable polyesters are aliphatic polyesters having the structure —[C(O)—R—O]$_n$—, wherein n is an integer representing the number of monomer units in the polymer chain and R is an aliphatic hydrocarbon, preferably a C1-C10 alkylene, more preferably a C1-C6 alkylene (e.g., methylene, ethylene, propylene, isopropylene, butylene, isobutylene, and the like), wherein the alkylene group can be a straight chain or branched. Exemplary aliphatic polyesters include polyglycolic acid (PGA), polylactic acid (PLA) (e.g., poly(L-lactic acid) or poly(DL-lactic acid)), polyhydroxyalkanoates (PHAs) such as polyhydroxypropionate, polyhydroxyvalerate, polyhydroxybutyrate, polyhydroxyhexanoate, and polyhydroxyoctanoate, polycaprolactone (PCL), polybutylene succinate adipate and copolymers thereof (e.g., polyhydroxybutyrate-co-hydroxyvalerate (PHBV)). Types of degradable polyester fibers are described in, for example, U.S. Pat. No. 5,817,159 to Cahill et al. and U.S. Pat. No. 6,062,228 to Loercks et al; and US Pat. Appl. Publication Nos. 2009/0288669 to Hutchens and 2009/0032037 to Xue et al., all of which are incorporated by reference herein. The degradable polyester polymer can be formed into fibers using conventional fiber spinning technology, such as for example, the fiber spinning equipment and processes taught in US Pat. Appl. Publication No. 2006/0159918 to Dugan et al., which is incorporated by reference herein.

One exemplary type of degradation is biodegradation. The term "biodegradable" as used in reference to a degradable polymer refers to a polymer that degrades under aerobic and/or anaerobic conditions in the presence of bacteria, fungi, algae, and other microorganisms to carbon dioxide/methane, water and biomass, although materials containing heteroatoms can also yield other products such as ammonia or sulfur dioxide. "Biomass" generally refers to the portion of the metabolized materials incorporated into the cellular structure of the organisms present or converted to humus fractions indistinguishable from material of biological origin.

Biodegradability can be measured, for example, by placing a sample in environmental conditions expected to lead to decomposition, such as placing a sample in water, a microbe-containing solution, a compost material, or soil. The degree of degradation can be characterized by weight loss of the sample over a given period of exposure to the environmental conditions. Exemplary rates of degradation for certain filter element embodiments of the invention include a weight loss of at least about 20% after burial in soil for 60 days or a weight loss of at least about 30% after 15 days of exposure to a typical municipal composter. However, rates of biodegradation can vary widely depending on the type of degradable particles used, the remaining composition of the filter element, and the environmental conditions associated with the degradation test. U.S. Pat. No. 5,970,988 to Buchanan et al. and U.S. Pat. No. 6,571,802 to Yamashita provide exemplary test conditions for degradation testing. The degradability of a plastic material also may be determined using one or more of the following ASTM test methods: D5338, D5526, D5988, and D6400.

Biodegradability varies from polymer to polymer. For example, the PHAs are known to be degradable by both aerobic and anaerobic microorganisms, which will allow them to biodegrade in a broad variety of environments. Although PHAs are generally considered difficult to extrude as fibers alone, they may be formed into fibers of acceptable strength by mixing different PHA polymers or mixing a PHA with other polymers, such as for example, PLA or other polymeric additives that enhance fiber spinning performance of biopolymers such as VINNEX® ethylene vinyl acetate copolymers available from Wacker Chemie AG.

As another example, PLA may be broken down through hydrolytic degradation, biodegradation, thermal degradation, and/or photodegradation, depending upon the environment and modifications performed on the polymer. As yet another example, polycaprolactone (PCL) is biodegradable, and its degradability can be enhanced when mixed with starch.

The degradable polyester can be in the form of a blend, either as a blend of different degradable polyesters or as a blend of one or more degradable polyesters and one or more additional polymers. For example, the polymer blend could include a second biodegradable polymer, such as polyvinyl alcohol, starch, aliphatic polyurethanes, polyesteramides, cis-polyisoprene, cis-polybutadiene, polyanhydrides, and copolymers and blends thereof. Additional examples of blending partners include thermoplastic cellulose, available from Toray Industries, Inc. of Japan and described in U.S. Pat. No. 6,984,631 to Aranishi et al., which is incorporated by reference herein, and thermoplastic polyesters such as Ecoflex® aliphatic-aromatic copolyester materials available from BASF Corporation or poly(ester urethane) polymers described in U.S. Pat. No. 6,087,465 to Seppälä et al., which is incorporated by reference herein in its entirety. Although relatively non-degradable synthetic polymers, such as certain aromatic polyesters (e.g., polyethylene terephthalate) or polyolefins (e.g., polyethylene, polypropylene), could also be used in a blend with the degradable polyester, the resulting composition would have decreased biodegradability.

In another embodiment, fibers constructed of the degradable polyester material (or a blend containing such a polymer material) are mixed with conventional cellulose acetate fibers to provide a fiber mixture. A filter formed in this manner will have a decreased biodegradability profile, but may exhibit improved organoleptic properties. Such embodiments may provide for improved dispersion of the cellulose acetate fibers within the fibrous tow, which can enhance degradation of such fibers.

In certain embodiments, the degradable polyester material (or blend containing such a polymer material) used in the invention will exhibit a high degree of biodegradability, will be fibrillatable, and/or will generally be capable of extrusion and processing into tow having sufficient strength to form cigarette filters (including during manufacture with standard or modified filter-making equipment known in the art). Additionally, if desired, a water soluble cellulose acetate polymer or water insoluble cellulose acetate based dispersion may be applied to the filaments of degradable polyester material described herein. Such treatment is described in U.S. application Ser. No. 12/827,618, filed Jun. 30, 2010, which is incorporated by reference herein.

The biodegradable polymer or polymer mixture may be formed as a bi-component fiber with the biodegradable material in the core of the fiber and a less biodegradable polymer in the shell. The proportion of the two polymer types can be such that the rate of biodegradation of the composite fiber remains relatively high. Exemplary sheath polymers include plasticized cellulose acetate (e.g., cellulose acetate materials available from Mazzucchelli 1849 S.p.A. of Italy) and copolymers of ethylene and vinyl acetate.

Referring back to FIG. 1, during use, the smoker lights the lighting end 18 of the cigarette 10 using a match or cigarette lighter. As such, the smokable material 12 begins to burn. The mouth end 20 of the cigarette 10 is placed in the lips of the smoker. Thermal decomposition products (e.g., components of tobacco smoke) generated by the burning smokable material 12 are drawn through the cigarette 10, through the filter element 26, and into the mouth of the smoker. Following use of the cigarette 10, the filter element 26 and any residual portion of the tobacco rod 12 can be discarded. The presence of the degradable polyester fibers can increase the rate of degradation of the discarded filter element 26.

To form a suitable filter element for use in smoking articles, such as cigarettes, it is desirable to add a solvent to the fibrous tow during manufacture of the filter element in order to soften the filaments and allows adjacent filaments to fuse together, which aids formation of a homogenous mass of fibers exhibiting increased rigidity. The solvent composition added during filter manufacture is commonly referred to as a plasticizer composition.

Conventional liquid plasticizers used with cellulose acetate tow fibers, such as triacetin, polyethylene glycol and tributyl citrate, are not effective when used with degradable polyester fibers such as PLA. The incompatibility of these plasticizers with degradable polyester fibers may be attributable to: (1) the solvent molecule being too large to penetrate the fiber surface; (2) the solvent having poor chemical affinity with the fiber surface; or (3) the solvent being incapable of swelling the fiber to make the fiber surface sufficiently tacky so that inter-fiber bonding can take place. Regardless of the reason, the conventional plasticizers used in the cigarette industry do not provide sufficient fiber-to-fiber bonding when used with degradable polyester fibers, and accordingly, fail to produce a filter element having the rigidity and cohesiveness associated with conventional cigarette filter elements.

Just as insufficient fiber-to-fiber bonding can lead to inferior plasticizer performance, a plasticizer composition can also perform poorly if the plasticizer aggressively dissolves the fiber in a short period of time, causing the fibers to lose physical integrity during the filter manufacturing process. Accordingly, advantageous plasticizer compositions provide a proper balance of fiber dissolution and inter-fiber bonding in order to achieve the desired filter tow characteristics.

In certain embodiments, the present invention provides a plasticizer composition characterized by a number of desirable properties. For example, certain embodiments of the plasticizer compositions of the invention have the following physical properties: (1) a relatively high boiling point (e.g., above about 200° C.); (2) a flash point above about 100° C.; (3) a National Fire Protection Agency (NFPA) health rating of 1 or less; (4) a NFPA fire rating of 1 or less; and (5) acceptably low odor such that a filter element made therewith does not have disadvantageous sensory characteristics.

Additionally, advantageous embodiments of the plasticizer compositions of the invention exhibit a certain degree of chemical affinity towards the degradable polyester fibers and are capable of penetrating such fibers and softening their surface. These embodiments of the plasticizer composition are capable of swelling such fibers and rendering them tacky so that inter-fiber bonding can occur, but without significant loss of the physical integrity of the fiber. It has been discovered that plasticizer compositions having appropriate levels of chemical affinity for degradable polyester fibers can be determined using a polymer-solvent interaction relationship proposed by Charles Hansen and commonly referred to as Hansen Solubility Parameters (HSP).

In the Hansen system, both the polymer molecule and the solvent molecule (or solvent mixture) are given three HSP parameters, each measured in units of $MPa^{0.5}$. The first parameter, $\delta_d$, represents the energy from dispersion bonds between molecules. The second parameter, $\delta_p$, represents the energy from dipolar intermolecular force between molecules. The third and final parameter, $\delta_h$, represents the energy from hydrogen bonds between molecules. These parameters are determined either experimentally or using tabular data for various solvents and polymers found in, for example, *Hansen Solubility Parameters: A user's handbook, Second Edition*. Boca Raton, Fla.: CRC Press (2007), which is incorporated by reference herein.

These three parameters are coordinates for a point in three dimensions known as the Hansen space. Close proximity between these points in Hansen space is suggestive of strong chemical affinity between the molecules of the polymer and solvent. By extension, it has been determined that close proximity in Hansen space also suggests that the solvent would be useful as part of a plasticizer composition in the present invention. In the Hansen system, to determine if the Hansen Solubility Parameters of the two molecules (solvent and polymer) are within a suitable range, a value called the interaction radius ($R_0$) is assigned to the polymer being dissolved. The $R_0$ value determines the radius of a sphere in Hansen space and its center is the three Hansen parameters for the polymer.

The $R_0$ value of a polymer can be determined by using a large number of liquids having different HSP numbers and observing solution behavior with respect to the subject polymer. The solution behavior may be characterized as completely soluble, partially soluble, insoluble, or swellable. The HSP sphere for a polymer is then constructed such that the solvents that dissolve the polymer completely are closest to the center, those that only dissolve the polymer partially are further away from the center, and so on. Those that swell the polymer are assigned locations beyond the ones that partially dissolve. The HSP sphere can then be constructed such that all solvents that dissolve completely or partially are within the sphere and those that do not dissolve are outside the sphere. On the edge of the sphere are solvents that swell the polymer.

To calculate the distance (Ra) for a new solvent, the following equation (Equation 1) is used (wherein the "1" subscripts are for the polymer and the "2" subscripts are for the solvent):)

$$(Ra)^2=4(\delta_{d2}-\delta_{d1})^2+(\delta_{p2}-\delta_{p1})^2+(\delta_{h2}-\delta_{h1})^2 \quad \text{Equation 1}$$

Once the Ra value is known, a ratio between Ra and the interaction radius ($R_0$) gives the Relative Energy Difference (RED) of the system according to Equation 2 below.

$$\text{RED}=Ra/R_0 \quad \text{Equation 2}$$

If the HSP values must be experimentally determined, one can begin by determining the energy required to evaporate a liquid of the molecule of interest according to Equation 3 below, where E is the total cohesion energy of the liquid, $\Delta H_V$ is the measured (or predicted) latent heat of vaporization, R is the universal gas constant, and T is the absolute temperature.

$$E=\Delta H_V-RT \quad \text{Equation 3}$$

As explained above, there are three HSP values corresponding to three sources of energy. By extension, it is understood that those values are derived from three separate parts of the total cohesion energy of a liquid, E: (1) the nonpolar, atomic (dispersion) interactions, $E_D$; (2) the permanent dipole molecular interactions, $E_P$; and (3) the hydrogen bonding (electron interchange) molecular interactions, $E_H$. Equation 4 below illustrates this relationship.

$$E=E_D+E_P+E_H \quad \text{Equation 4}$$

The HSP values are determined from the energy values by first dividing Equation 4 by the molar volume, V, as shown in Equation 5 below. The total cohesion energy divided by molar volume is the total cohesion energy density, and the square root of the total cohesion energy density is the total solubility parameter, δ. Accordingly, the total solubility parameter for a given molecule relates to the HSP values of that molecule as shown in Equation 6 below.

$$E/V=(E_D/V)+(E_P/V)+(E_H/V) \quad \text{Equation 5}$$

$$\delta^2=\delta_D^2+\delta_P^2+\delta_H^2 \quad \text{Equation 6}$$

Returning to the Relative Energy Difference (RED) of the system, RED values above 1 represent solvent-polymer systems with relatively poor chemical affinity, meaning RED values significantly greater than 1 would not be expected to be useful as a plasticizer composition of the invention. Instead, in certain embodiments, the invention provides plasticizer composition/degradable polyester systems having a RED value of less than about 1.3, less than about 1.2, less than about 1.1, less than about 1.0, less than about 0.9, less than about 0.8, less than about 0.7, or even less than about 0.6. In some embodiments, an advantageous RED range for the plasticizer/polymer combination is about 0.1 to about 0.9, often about 0.3 to about 0.8, and more often about 0.4 to about 0.7.

Figure 2:
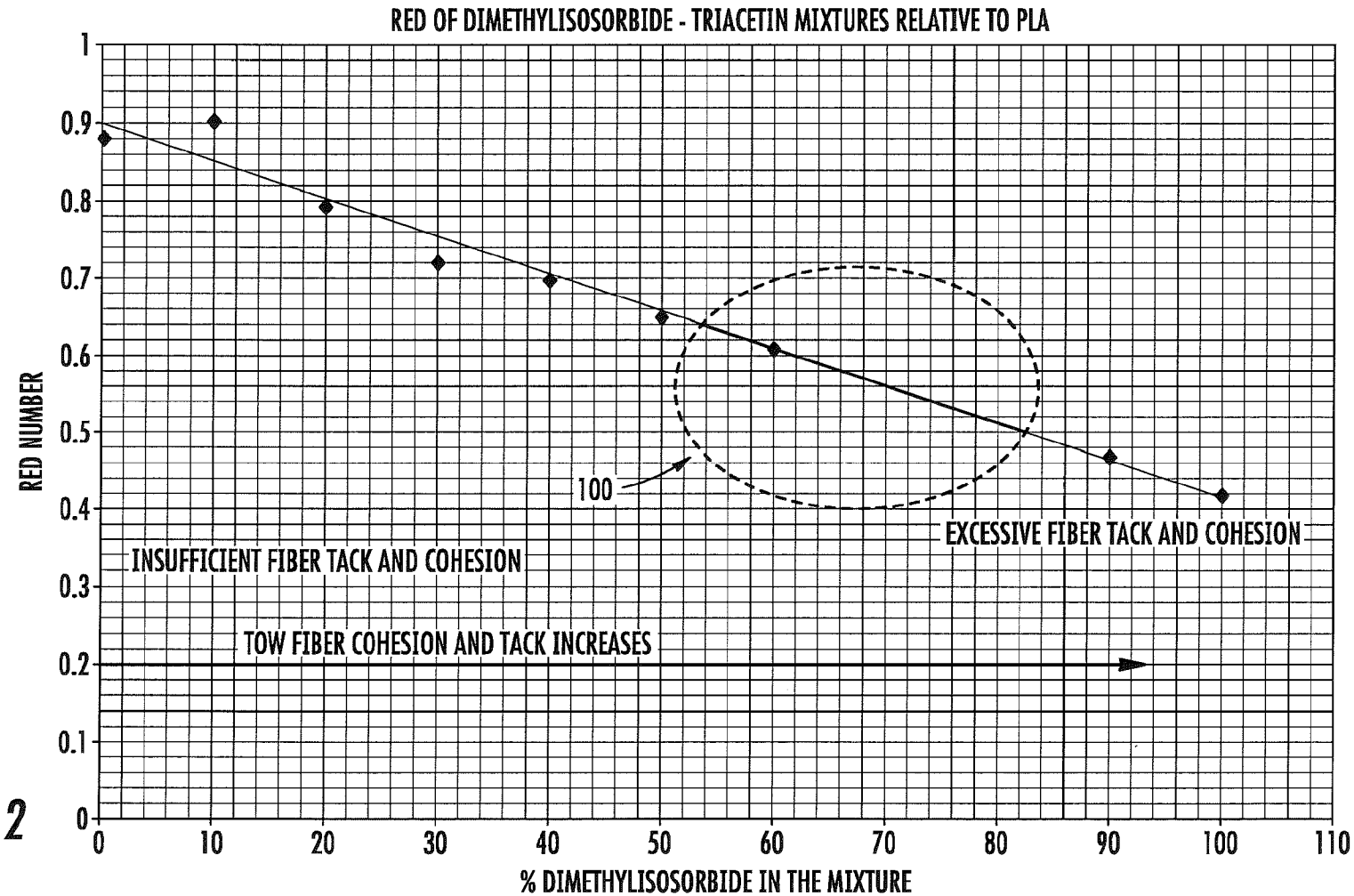
FIG. 2 graphically illustrates the Relative Energy Density (RED) of plasticizer mixtures of dimethylisosorbide and triacetin relative to polylactic acid.

The RED values for a polymer-solvent system comprising polylactic acid as the polymer and mixtures of dimethylisosorbide and triacetin as the plasticizer are set forth in FIG. 2. As shown, PLA tow fiber cohesion and tack are believed to increase with increasing molar volume percentage of dimethylisosorbide, which is to be expected since triacetin has very poor chemical affinity for PLA fibers. Marked on FIG. 2 as area 100, it is estimated that the best performance in terms of cigarette filter plasticization will be obtained with a dimethylisosorbide volume fraction of about 0.50 to about 0.85 (the balance being triacetin), which provides a RED value of about 0.4 to about 0.75. Accordingly, in certain embodiments, the plasticizer composition comprises at least about 0.4 or at least about 0.5 or at least about 0.6 volume fraction of dimethylisosorbide, with the balance being triacetin.

Table 1 below provides other solvents and mixtures of solvents that are believed to be useful, in certain embodiments, as a plasticizer composition used in combination with a degradable polyester fibrous tow. The table provides volume fraction of each solvent and the RED value for each solvent or solvent mixture relative to polylactic acid as the filter tow polymer to be plasticized.

TABLE 1

| | SOLVENT | | | | | |
|---|---|---|---|---|---|---|
| | Propylene Carbonate | 3-Methylbenzyl Alcohol | Triacetin | Glycerol Carbonate Acetate | Glycerol Carbonate Ethyl Ester | RED |
| 1 | 0.27 | 0.37 | 0.25 | 0.03 | 0.08 | 0 |
| 2 | 0.36 | 0.40 | 0.24 | x | x | 0.10 |
| 3 | x | 0.38 | 0.29 | x | 0.33 | 0.25 |
| 4 | x | 0.29 | 0.28 | 0.43 | x | 0.29 |
| 5 | 0.43 | 0.57 | x | x | x | 0.35 |
| 6 | 0.57 | 0.43 | x | x | x | 0.35 |
| 7 | 0.36 | 0.56 | x | x | 0.08 | 0.35 |
| 8 | 0.18 | x | 0.41 | 0.41 | x | 0.39 |
| 9 | x | x | 0.42 | 0.58 | x | 0.44 |
| 10 | x | 0.61 | x | x | 0.39 | 0.49 |
| 11 | x | 0.48 | x | 0.52 | x | 0.50 |
| 12 | 0.27 | x | 0.50 | x | 0.23 | 0.50 |
| 13 | 0.48 | x | 0.52 | x | x | 0.54 |
| 14 | x | x | 0.54 | x | 0.46 | 0.56 |
| 15 | x | 0.59 | 0.41 | x | x | 0.65 |
| 16 | 0.22 | x | x | 0.78 | x | 0.81 |
| 17 | x | x | x | 1.0 | x | 0.82 |
| 18 | x | x | x | 0.99 | 0.01 | 0.84 |
| 19 | x | 1.0 | x | x | x | 0.90 |
| 20 | 0.62 | x | x | x | 0.38 | 1.09 |
| 21 | 1.0 | x | x | x | x | 1.13 |
| 22 | x | x | x | x | 1.0 | 1.23 |

Accordingly, in certain embodiments, the plasticizer composition of the invention includes one or more of dimethylisosorbide, propylene carbonate, methylbenzyl alcohol (e.g., 3-methylbenzyl alcohol), glycerol carbonate acetate, and glycerol carbonate ethyl ether, or a mixture thereof. It can be desirable to optionally combine one or more of the above-noted solvents with triacetin in the plasticizer composition. Although triacetin does not have sufficient chemical affinity for degradable polyester materials to function as a plasticizer by itself, the presence of triacetin in a smoking article filter can produce favorable effects on mainstream smoke, such as desirable chemical affinity for certain constituents of smoke and a positive effect on taste or other organoleptic properties. Thus, in some embodiments, the plasticizer composition is a mixture of solvents including at least about 0.1 volume fraction of triacetin, or at least about 0.2, or at least about 0.3, or at least about 0.4, or at least about 0.5, with the balance being one or more additional solvents such as any of the solvents noted herein. In some cases, the amount of triacetin in the plasticizer composition is about 0.1 to about 0.6 volume fraction, more often about 0.1 to about 0.5, with the balance being one or more additional solvents such as any of the solvents noted herein.

The amount of plasticizer composition added to a filter tow can vary, and will depend in part on the particular solvents used in the composition, the desired rigidity of the filter tow, and the type of degradable polyester used. The total amount of plasticizer is generally about 4 to about 20 percent by weight, preferably about 6 to about 12 percent by weight, based on the total weight of the plasticized filter tow.

Filaments of the degradable polyester material can be formed into a fibrous tow using techniques known in the art. The process of forming the actual filter element typically involves mechanically withdrawing a degradable polyester crimped tow from a bale and separating the fibers into a ribbon-like band. The tow band is subjected to a "blooming" process wherein the tow band is separated into individual fibers. Blooming can be accomplished, for example, by applying different tensions to adjacent sections of the tow band or applying pneumatic pressure. The bloomed tow band then passes through a relaxation zone that allows the fibers to contract, followed by passage into a bonding station. The bonding station applies the plasticizer taught herein to the bloomed fibers, which softens the fibers and allows adjacent fibers to fuse together. The bonding process forms a homogenous mass of fibers with increased rigidity.

The bonded tow is then wrapped in plug wrap and cut into filter rods. Exemplary processes and equipment for forming filter tow from cellulose acetate or other polymers, which can be used (or modified for use) to produce a cigarette filter comprising degradable polyester fibers and a plasticizer composition according to the invention, are set forth in U.S. Pat. No. 2,953,838 to Crawford et al.; U.S. Pat. No. 2,794,239 to Crawford et al.; U.S. Pat. No. 3,890,983 to Sawada et al.; U.S. Pat. No. 5,947,126 to Wilson et al.; U.S. Pat. No. 6,062,228 to Loercks et al; U.S. Pat. No. 6,924,029 to Caenen et al.; and U.S. Pat. No. 7,896,011 to Grubbs et al.; and US Pat. Application Publication No. 2008/0245376 to Travers et al., all of which are incorporated by reference herein.

Alternatively, the degradable polyester fibers can be formed into a nonwoven sheet (e.g., using a melt-blown or spun-bond process), and formed into a filter element by rolling, folding or shredding the resulting sheet material. The fibers could also be used in the form of a gathered web. In any of these alternative embodiments, use of a plasticizer could still be advantageous to achieve desired rigidity and inter-fiber bonding.

Components for filter elements for filtered cigarettes typically are provided from filter rods that are produced using traditional types of rod-forming units, such as those available as KDF-2 and KDF-3E from Hauni-Werke Korber & Co. KG. Typically, filter material, such as filter tow, is provided using a tow processing unit. An exemplary tow processing unit has been commercially available as E-60 supplied by Arjay Equipment Corp., Winston-Salem, N.C. Other exemplary tow processing units have been commercially available as AF-2, AF-3, and AF-4 from Hauni-Werke Korber & Co. KG. In addition, representative manners and methods for operating a filter material supply units and filter-making units are set forth in U.S. Pat. No. 4,281,671 to Byrne; U.S. Pat. No. 4,862,905 to Green, Jr. et al.; U.S. Pat. No. 5,060,664 to Siems et al.; U.S. Pat. No. 5,135,008 to Oesterling et al.; U.S. Pat. No. 5,387,285 to Rivers; and U.S. Pat. No. 7,074,170 to Lanier, Jr. et al.; and US Pat. Appl. Pub. Nos. 2010/0099543 to Deal and 2010/0192962 to Nelson et al., all of which are incorporated by reference. Other types of technologies for supplying filter materials to a filter rod-forming unit are set forth in U.S. Pat. No. 4,807,809 to Pryor et al. and U.S. Pat. No. 5,025,814 to Raker; which are also incorporated herein by reference.

Filter elements, or filter segment components of combination filters, typically are provided from filter rods that are manufactured using traditional types of cigarette filter rod making techniques. For example, so-called "six-up" filter rods, "four-up" filter rods and "two-up" filter rods that are of the general format and configuration conventionally used for the manufacture of filtered cigarettes can be handled using conventional-type or suitably modified cigarette rod handling devices, such as tipping devices available as Lab MAX, MAX, MAX S or MAX 80 from Hauni-Werke Korber & Co. KG. See, for example, the types of devices set forth in U.S. Pat. No. 3,308,600 to Erdmann et al.; U.S. Pat. No. 4,238,993 to Brand et al.; U.S. Pat. No. 4,281,670 to Heitmann et al.; U.S. Pat. No. 4,280,187 to Reuland et al.; U.S. Pat. No. 4,850,301 to Greene, Jr. et al.; U.S. Pat. No. 6,135,386 to Garthaffner; U.S. Pat. No. 6,229,115 to Voss et al.; and U.S. Pat. No. 7,434,585 to Holmes, and US Pat. Appl. Pub. Nos. 2005/1094014 to Read, Jr., and 2006/0169295 to Draghetti, each of which is incorporated herein by reference. The operation of those types of devices will be readily apparent to those skilled in the art of automated cigarette manufacture.

Cigarette filter rods can be used to provide multi-segment filter rods. Such multi-segment filter rods then can be employed for the production of filtered cigarettes possessing multi-segment filter elements. An example of a two-segment filter element is a filter element possessing a first cylindrical segment incorporating activated charcoal particles dispersed within cellulose acetate tow (e.g., a "dalmation" type of filter segment) at one end, and a second cylindrical segment that is produced from a filter rod produced essentially of flavored, plasticized cellulose acetate tow filter material at the other end. The production of multi-segment filter rods can be carried out using the types of rod-forming units that traditionally have been employed to provide multi-segment cigarette filter components. Multi-segment cigarette filter rods can be manufactured using a cigarette filter rod making device available under the brand name Mulfi from Hauni-Werke Korber & Co. KG of Hamburg, Germany. Representative types of filter designs and components, including representative types of segmented cigarette filters, are set forth in U.S. Pat. No. 4,920,990 to Lawrence et al.; U.S. Pat. No. 5,012,829 to Thesing et al.; U.S. Pat. No. 5,025,814 to Raker; U.S. Pat. No. 5,074,320 to Jones et al.; U.S. Pat. No. 5,105,838 to White et al.; U.S. Pat. No. 5,271,419 to Arzonico et al.; U.S. Pat. No. 5,360,023 to Blakley et al.; U.S. Pat. No. 5,396,909 to Gentry et al.; and U.S. Pat. No. 5,718,250 to Banerjee et al; US Pat. Appl. Pub. Nos. 2002/0166563 to Jupe et al.; 2004/0261807 to Dube et al.; 2005/0066981 to Crooks et al.; and 2007/0056600 to Coleman III, et al.; PCT Publication No. WO 03/009711 to Kim; and PCT Publication No. WO 03/047836 to Xue et al.; which are incorporated herein by reference.

If desired, the filter element of the invention also can be incorporate other components that have the ability to alter the properties of mainstream smoke that passes through the filter element, such as adsorbent materials or flavorants. Exemplary adsorbent materials include activated carbon and ion exchange resins, and exemplary flavorants include flavorant-containing capsules and solid botanical additives such as peppermint or spearmint leaves or other plant-based flavorants in particulate form. See, for example, U.S. Pat. No. 5,387,285 to Rivers; U.S. Pat. No. 6,041,790 to Smith et al.; U.S. Pat. No. 7,479,098 to Thomas et al.; U.S. Pat. No. 7,669,604 to Crooks et al.; U.S. Pat. No. 7,833,146 to Deal; U.S. Pat. No. 7,836,895 to Dube et al.; and U.S. Pat. No. 7,972,254 to Stokes et al; and US Pat. Appl. Publication Nos. 2004/0237984 to Figlar et al.; 2005/0268925 to Schluter et al.; 2006/0130861 to Luan et al.; 2006/0174899 to Luan et al.; 2011/0162662 to Nikolov et al.; and 2011/0162665 to Burov et al., which are incorporated herein by reference. Other suitable materials or additives used in the construction of the filter element will be readily apparent to those skilled in the art of cigarette filter design and manufacture.

Various filter element arrangements could be used without departing from the invention. The filter element of the invention typically comprises multiple, longitudinally-extending segments. Each segment can have varying properties and may include various materials capable of filtration or adsorption of particulate matter and/or vapor phase compounds. The filter element can further include a cavity formed between two filter tow segments. One or more sections of fibrous tow can also include channels or tubes formed therein.

The particulate removal efficiency, denier per filament, fiber cross-sectional shape, and total volume of fibers of the filamentary or fibrous tow of degradable polyester can vary. The denier per filament, fiber cross-section, and total denier of the fibrous tow affect the pressure drop across a given filter segment, and thus, those characteristics of the filamentary tow can be adjusted as desired to achieve a particular pressure drop across the filter element. An exemplary range of denier per filament is about 1 to about 10 denier per filament, and a typical range of total denier is about 25,000 to about 45,000. Exemplary fiber cross-sectional shapes include circular and Y-shaped. For further examples, see the filter descriptions set forth in U.S. Pat. No. 3,424,172 to Neurath; U.S. Pat. No. 4,811,745 to Cohen et al.; U.S. Pat. No. 4,925,602 to Hill et al.; U.S. Pat. No. 5,225,277 to Takegawa et al. and U.S. Pat. No. 5,271,419 to Arzonico et al.; each of which is incorporated herein by reference.

For cigarettes that are air diluted or ventilated, the amount or degree of air dilution or ventilation can vary. Frequently, the amount of air dilution for an air diluted cigarette is greater than about 10 percent, generally is greater than about 20 percent, often is greater than about 30 percent, and sometimes is greater than about 40 percent. Typically, the upper level for air dilution for an air diluted cigarette is less than about 80 percent, and often is less than about 70 percent. As used herein, the term "air dilution" is the ratio (expressed as a percentage) of the volume of air drawn through the air dilution means to the total volume and air and smoke drawn through the cigarette and exiting the extreme mouth end portion of the cigarette.

Preferred cigarettes of the present invention exhibit desirable resistance to draw. For example, an exemplary cigarette exhibits a pressure drop of between about 50 and about 200 mm water pressure drop at 17.5 cc/sec. air flow. Preferred cigarettes exhibit pressure drop values of between about 60 mm and about 180, more preferably between about 70 mm to about 150 mm, water pressure drop at 17.5 cc/sec. air flow. Typically, pressure drop values of cigarettes are measured using a Filtrona Cigarette Test Station (CTS Series) available from Filtrona Instruments and Automation Ltd.

The dimensions of a representative cigarette 10 can vary. Preferred cigarettes are rod-shaped, and can have diameters of about 7.5 mm (e.g., circumferences of about 20 mm to about 27 mm, often about 22.5 mm to about 25 mm); and can have total lengths of about 70 mm to about 120 mm, often about 80 mm to about 100 mm. The length of the filter element 30 can vary. Typical filter elements can have total lengths of about 15 mm to about 40 mm, often about 20 mm to about 35 min. For a typical dual-segment filter element, the downstream or mouth end filter segment often has a length of about 10 mm to about 20 mm; and the upstream or tobacco rod end filter segment often has a length of about 10 mm to about 20 mm.

Various types of cigarette components, including tobacco types, tobacco blends, top dressing and casing materials, blend packing densities and types of paper wrapping materials for tobacco rods, can be employed. See, for example, the various representative types of cigarette components, as well as the various cigarette designs, formats, configurations and characteristics, that are set forth in Johnson, Development of Cigarette Components to Meet Industry Needs, 52$^{nd}$ T.S.R.C. (September 1998); U.S. Pat. No. 5,101,839 to Jakob et al.; U.S. Pat. No. 5,159,944 to Arzonico et al.; U.S. Pat. No. 5,220,930 to Gentry and U.S. Pat. No. 6,779,530 to Kraker; US Pat. Appl. Pub. Nos. 2005/0016556 to Ashcraft et al.; 2005/0066986 to Nestor et al.; 2005/0076929 to Fitzgerald et al.; 2006/0272655 to Thomas et al.; 2007/0056600 to Coleman, III et al.; and 2007/0246055 to Oglesby, each of which is incorporated herein by reference. Typically, the entire smokable rod is composed of smokable material (e.g., tobacco cut filler) and a layer of circumscribing outer wrapping material.

The filter elements of the present invention can be incorporated within aerosol-generating smoking articles that do not combust tobacco material to any significant degree, such as those set forth in U.S. Pat. No. 4,756,318 to Clearman et al.; U.S. Pat. No. 4,714,082 to Banerjee et al.; U.S. Pat. No. 4,771,795 to White et al.; U.S. Pat. No. 4,793,365 to Sensabaugh et al.; U.S. Pat. No. 4,989,619 to Clearman et al.; U.S. Pat. No. 4,917,128 to Clearman et al.; U.S. Pat. No. 4,961,438 to Korte; U.S. Pat. No. 4,966,171 to Serrano et al.; U.S. Pat. No. 4,969,476 to Bale et al.; U.S. Pat. No. 4,991,606 to Serrano et al.; U.S. Pat. No. 5,020,548 to Farrier et al.; U.S. Pat. No. 5,027,836 to Shannon et al.; U.S. Pat. No. 5,033,483 to Clearman et al.; U.S. Pat. No. 5,040,551 to Schlatter et al.; U.S. Pat. No. 5,050,621 to Creighton et al.; U.S. Pat. No. 5,052,413 to Baker et al.; U.S. Pat. No. 5,065,776 to Lawson; U.S. Pat. No. 5,076,296 to Nystrom et al.; U.S. Pat. No. 5,076,297 to Farrier et al.; U.S. Pat. No. 5,099,861 to Clearman et al.; U.S. Pat. No. 5,105,835 to Drewett et al.; U.S. Pat. No. 5,105,837 to Barnes et al.; U.S. Pat. No. 5,115,820 to Hauser et al.; U.S. Pat. No. 5,148,821 to Best et al.; U.S. Pat. No. 5,159,940 to Hayward et al.; U.S. Pat. No. 5,178,167 to Riggs et al.; U.S. Pat. No. 5,183,062 to Clearman et al.; U.S. Pat. No. 5,211,684 to Shannon et al.; U.S. Pat. No. 5,240,014 to Deevi et al.; U.S. Pat. No. 5,240,016 to Nichols et al.; U.S. Pat. No. 5,345,955 to Clearman et al.; U.S. Pat. No. 5,396,911 to Casey, III et al.; U.S. Pat. No. 5,551,451 to Riggs et al.; U.S. Pat. No. 5,595,577 to Bensalem et al.; U.S. Pat. No. 5,727,571 to Meiring et al.; U.S. Pat. No. 5,819,751 to Barnes et al.; U.S. Pat. No. 6,089,857 to Matsuura et al.; U.S. Pat. No. 6,095,152 to Beven et al; and U.S. Pat. No. 6,578,584 to Beven; and US Pat. Appl. Pub. Nos. 2010/0186757 to Crooks et al. and 2011/0041861 to Sebastian et al., which are incorporated herein by reference. Still further, filter elements of the present invention can be incorporated within the types of cigarettes that have been commercially marketed under the brand names "Premier" and "Eclipse" by R. J. Reynolds Tobacco Company. See, for example, those types of cigarettes described in Chemical and Biological Studies on New Cigarette Prototypes that Heat Instead of Burn Tobacco, R. J. Reynolds Tobacco Company Monograph (1988) and Inhalation Toxicology, 12:5, p. 1-58 (2000); which are incorporated herein by reference.

Cigarette rods typically are manufactured using a cigarette making machine, such as a conventional automated cigarette rod making machine Exemplary cigarette rod making machines are of the type commercially available from Molins PLC or Hauni-Werke Korber & Co. KG. For example, cigarette rod making machines of the type known as MkX (commercially available from Molins PLC) or PROTOS (commercially available from Hauni-Werke Korber & Co. KG) can be employed. A description of a PROTOS cigarette making machine is provided in U.S. Pat. No. 4,474,190 to Brand, at col. 5, line 48 through col. 8, line 3, which is incorporated herein by reference. Types of equipment suitable for the manufacture of cigarettes also are set forth in U.S. Pat. No. 4,781,203 to La Hue; U.S. Pat. No. 4,844,100 to Holznagel; U.S. Pat. No. 5,131,416 to Gentry; U.S. Pat. No. 5,156,169 to Holmes et al.; U.S. Pat. No. 5,191,906 to Myracle, Jr. et al.; U.S. Pat. No. 6,647,870 to Blau et al.; U.S. Pat. No. 6,848,449 to Kitao et al.; U.S. Pat. No. 6,854,469 to Hancock et al; U.S. Pat. No. 6,904,917 to Kitao et al.; and U.S. Pat. No. 7,677,251 to Barnes et al.; and US Pat. Appl. Pub. Nos. 2003/0145866 to Hartman; 2004/0129281 to Hancock et al.; 2005/0039764 to Barnes et al.; and 2005/0076929 to Fitzgerald et al.; each of which is incorporated herein by reference.

The components and operation of conventional automated cigarette making machines will be readily apparent to those skilled in the art of cigarette making machinery design and operation. For example, descriptions of the components and operation of several types of chimneys, tobacco filler supply equipment, suction conveyor systems and garniture systems are set forth in U.S. Pat. No. 3,288,147 to Molins et al.; U.S. Pat. No. 3,915,176 to Heitmann et al.; U.S. Pat. No. 4,291,713 to Frank; U.S. Pat. No. 4,574,816 to Rudszinat; U.S. Pat. No. 4,736,754 to Heitmann et al. U.S. Pat. No. 4,878,506 to Pinck et al.; U.S. Pat. No. 4,899,765 to Davis et al.; U.S. Pat. No. 5,060,665 to Heitmann; U.S. Pat. No. 5,012,823 to Keritsis et al. and U.S. Pat. No. 6,360,751 to Fagg et al.; and US Pat. Appl. Pub. No. 2003/0136419 to Muller; each of which is incorporated herein by reference. The automated cigarette making machines of the type set forth herein provide a formed continuous cigarette rod or smokable rod that can be subdivided into formed smokable rods of desired lengths.

EXPERIMENTAL

Triacetin and dimethylisosorbide (DMI) solvent mixtures having different RED numbers are evaluated as PLA plasticizers by a simple lab experiment. Approximately 23.6 cm long and 8.5 mm diameter PLA filters rods are made using a KDF-2 filter maker, except that no plasticizer is used during this process. The un-plasticized filter rods are then cut open and the paper is completely removed from the bundle. The bundle is then opened and spread out, without losing the parallel alignment of the tow fibers, into an approximately 60-70 mm wide web. The opened tow bundle with fibers mostly aligned parallel to each other is then sprayed with the experimental solvent mixture using an aerosol spray can such that the whole bundle is wet with solvent mixture. Each spraying is done in a consistent manner one forward pass, one backward pass, and one final forward pass. The wet pick-up on the fiber bundle is not measured, so there may be some variability between each spray.

The wet fiber bundle is then gathered manually and inserted into a 10.9 cm long and 8.5 mm diameter plastic tube. During this insertion process, the fiber bundle is subjected to twisting and compression, the extents of which may vary somewhat from one experiment to another. The wet fiber bundle is then allowed to dry for approximately 72 hours before making observations. After the 72 hour period, all the tows are removed from the tubes and examined for evidence of fiber bonding qualitatively. There is clearly a fiber bonding pattern within the series of tows. Those that have the highest levels of DMI exhibit excessive fiber bonding, whereas those with little DMI exhibit no fiber bonding. With 100% DMI the fibers are not visible, and instead the whole bundle is a tacky mass of material. With decreasing levels of DMI, the fibers gradually retain their integrity and also bond to one another. Upon further decreasing of DMI level in the mixture, there is hardly any fiber bonding. Hence, there appears to be an optimum range of triacetin-DMI at which the fiber bonding could be considered most suitable for cigarette filter applications. The data from this experiment is graphically presented in FIG. 2.

Many modifications and other embodiments of the invention will come to mind to one skilled in the art to which this invention pertains having the benefit of the teachings presented in the foregoing description; and it will be apparent to those skilled in the art that variations and modifications of the present invention can be made without departing from the scope or spirit of the invention. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A fibrous tow adapted for use in a smoking article comprising a plurality of filaments of a degradable polyester and a plasticizer composition applied thereto, the plasticizer composition and the degradable polyester having a Relative Energy Difference calculated using Hansen Solubility Parameters of less than about 1.3, wherein the plasticizer composition comprises at least one solvent selected from the group consisting of dimethylisosorbide, propylene carbonate, methylbenzyl alcohol, glycerol carbonate acetate, glycerol carbonate ethyl ether, and mixtures thereof.

2. The fibrous tow of claim 1, wherein the degradable polyester is selected from the group consisting of polyglycolic acid, polylactic acid, polyhydroxyalkanoates, polycaprolactone, polybutylene succinate adipate and copolymers or blends thereof.

3. The fibrous tow of claim 1, wherein the degradable polyester is polylactic acid or a blend or copolymer comprising polylactic acid.

4. The fibrous tow of claim 1, wherein the degradable polyester is a blend of the degradable polyester and a second biodegradable polymer.

5. The fibrous tow of claim 1, wherein the Relative Energy Difference is less than about 1.0.

6. The fibrous tow of claim 1, wherein the Relative Energy Difference is less than about 0.8.

7. The fibrous tow of claim 1, wherein the Relative Energy Difference is less than about 0.7.

8. The fibrous tow of claim 1, wherein the plasticizer composition further comprises triacetin.

9. The fibrous tow of claim 1, wherein the plasticizer composition comprises at least about 0.10 volume fraction of triacetin.

10. The fibrous tow of claim 1, wherein the plasticizer composition comprises at least about 0.5 volume fraction of dimethylisosorbide with the balance being triacetin.

11. The fibrous tow of claim 1, wherein the plasticizer composition comprises between about 0.5 and about 0.85 volume fraction of dimethylisosorbide and the balance being triacetin.

12. The fibrous tow of claim 1, wherein the plasticizer composition has a boiling point above about 200° C., a flash point above about 100° C., a National Fire Protection Agency health rating of 1 or less, and a National Fire Protection Agency fire rating of 1 or less.

13. A fibrous tow adapted for use in a smoking article comprising a plurality of polymeric filaments of polylactic acid, or a blend or copolymer comprising polylactic acid, and a plasticizer composition applied thereto, the plasticizer composition and the polymeric filaments having a Relative Energy Difference calculated using Hansen Solubility Parameters of less than about 1.3, and the plasticizer composition comprising triacetin in combination with one or more additional solvents selected from the group consisting of dimethylisosorbide, propylene carbonate, methylbenzyl alcohol, glycerol carbonate acetate, glycerol carbonate ethyl ether, and mixtures thereof.

14. The fibrous tow of claim 13, wherein the plasticizer composition comprises at least about 0.10 volume fraction of triacetin.

15. The fibrous tow of claim 13, wherein the plasticizer composition comprises at least about 0.5 volume fraction of dimethylisosorbide with the balance being triacetin.

16. The fibrous tow of claim 13, wherein the Relative Energy Difference is less than about 1.0.

17. The fibrous tow of claim 13, wherein the Relative Energy Difference is less than about 0.8.

18. The fibrous tow of claim 13, wherein the Relative Energy Difference is less than about 0.7.

19. A cigarette comprising a tobacco rod having a smokable filler material contained within a circumscribing wrapping material and a filter element connected to the tobacco rod at one end of the tobacco rod, said filter element comprising at least one segment of fibrous tow according to claim 1.

20. A cigarette comprising a tobacco rod having a smokable filler material contained within a circumscribing wrapping material and a filter element connected to the tobacco rod at one end of the tobacco rod, said filter element comprising at least one segment of fibrous tow according to claim 13.

* * * * *